US005531088A

United States Patent [19]

Inatani

[11] Patent Number: 5,531,088

[45] Date of Patent: Jul. 2, 1996

[54] ROTARY FORGING APPARATUS

[75] Inventor: Shujiro Inatani, Osaka, Japan

[73] Assignee: Rays Engineering Co., Ltd., Osaka, Japan

[21] Appl. No.: 338,092

[22] Filed: Nov. 9, 1994

[30] Foreign Application Priority Data

Nov. 10, 1993 [JP] Japan ..... 5-281510

[51] Int. Cl.[6] ..... B21D 5/00; B21D 22/00; B21D 22/14

[52] U.S. Cl. ..... 72/84; 72/82

[58] Field of Search ..... 72/67, 82, 83, 72/84, 85, 110

[56] References Cited

U.S. PATENT DOCUMENTS 3,823,591 7/1974 Schöder et al. ..... 72/83
4,982,589 1/1991 Nomura ..... 72/67

FOREIGN PATENT DOCUMENTS 509610 10/1992 European Pat. Off. .
602951 6/1994 European Pat. Off. .
4-307347 11/1992 Japan ..... 72/84
6-154932 6/1994 Japan ..... 72/84

OTHER PUBLICATIONS

JAPAN – vol. 18, No. 472 (M–1667) – 2 Sep. 1994.
JAPAN –vol. 16, No. 26 (M–1202) – 22 Jan. 1992.

*Primary Examiner*—Lowell A. Larson
*Assistant Examiner*—Rodney A. Butler
*Attorney, Agent, or Firm*—Law Office of Steven M. Rabin

[57] ABSTRACT

A rotary forging apparatus includes a first rotary ram (3*a*), a cylindrical second rotary ram (3*b*), a third rotary ram (3*c*) and a shaping roller device. The first ram (3*a*) and the cylindrical second ram (3*b*) face each other and rotate around the same axis. The third ram (3*c*) rotates around a slanting axis in the cylindrical second ram (3*b*). The third ram (3*c*) presses a workpiece against the first ram (3*a*) and makes a disc part of a product. The shaping roller, the second ram (3*b*) and a side of the first ram make the rim part. The outer surface of the second ram (3*b*) can keep tight contact with the workpiece during the forging because of the rotational symmetry of the second ram (3*b*). The overall contact stabilizes the position of the workpiece and reduces the size error of the product.

12 Claims, 13 Drawing Sheets

ROTARY FORGING APPARATUS

FIELD OF THE INVENTION

This application claims the priority of Japanese Patent Application No. 281510/1993 filed Nov. 10, 1993, which is incorporated herein by reference.

This invention relates to a rotary forging apparatus for making a product having a disc part and a rim part formed around the disc part, for example, a wheel of an automobile, from a metal suitable for plastic working, for example aluminium alloys by hot forging.

PRIOR ART AND THE PROBLEMS

Japanese Patent Application No. 4-307347(307347/'92) proposed a rotary forging apparatus. FIG. 1 to FIG. 3 illustrate such a rotary forging apparatus for making a wheel with a disc part and a rim part. Tim forging apparatus comprises a lower rotary ram (30*a*) having a pressing top surface coinciding with the outer surface of a disc part (1) and the inner surface of an outer rim part of an automobile wheel, an upper rotary ram (30*b*) facing the lower ram (30*a*) and having an umbrella-shaped pressing bottom surface formed after the inner surface of the disc part (1), and a shaping roller device (4) consisting of a first shaping roller (4*a*) and a second shaping roller (4*b*) for forming the outer surface of the rim part. The upper rotary ram (30*b*) has a rotary axis slightly slanting to the rotary axis of the lower ram (30*a*). The upper ram (30*b*) is provided with an outer surface coinciding with the inner surface of the inner rim and the inner surface of the disc part (1). The roller device is supported at the height between the upper ram (30*b*) and the lower ram (30*a*) with a freedom of displacement in the radial direction and the axial direction.

This apparatus adopts as a starting material a tray-like metal workpiece (10) having a central starting disc part (11) and a cylindrical starting rim part (12) bending at the periphery of the rim part (12). The starting material is sometimes called a "workpiece" in this description. The Final, finished material is sometimes called a "product" in order to distinguish the final product from the starting material. The material is gradually and continuously transformed from a workpiece to a product without a change of weight. The product has a rim part and a disc part.

The lower ram (30*a*) and upper ram (30*b*) sandwich the starting material, i.e. the workpiece (10) both from the top and the bottom. The outer surface of the upper ram (30*b*) is in tight contact with the inner surface of the starting rim part (12) and the starting disc part (11) only in the direction of the inclined axis of the upper ram (30*b*). The synchronously rotating rams (30*b*) and (30*a*) press the work (10) together with strong forces. The starting disc part (11) is transformed into a final disc part (1) by the action of the upper ram (30*b*) and the lower ram (30*a*). The first roller (4*a*) presses the starting rim part (12) In the radial direction against the upper ram (30*b*). The starting rim part (12) is changed into an intermediate rim part (2) with a drop center (200), as shown in FIG. 2. Then the second roller (4*b*) finishes the other rim part into its final shape, as shown in FIG. 3.

The rotary forging apparatus enables a heightened productivity of forging to be obtained in comparison to a non-rotary forging apparatus, by finishing the disc part (1) and the rim part (2) continually and simultaneously. The apparatus has yet another advantage of allowing the pressing force to be reduced to a great extent in comparison with the conventional static (non-rotating) forging, because the disc part (1) is always pressed upon in a narrow region by the rotating ram.

The rotary forging apparatus rotates the starting rim part (12) and thins only a portion of the starting rim part which just passes a localized narrow pressing spot between two of the first roller (4*a*), the upper ram (30*b*) and the lower ram (30*a*) or another localized narrow pressing spot between two of the second roller (4*b*), the upper ram (30*b*) and the lower ram (30*a*), as shown in FIG. 2, FIG. 4 and FIG. 5. The thickness of the starting rim part is gradually reduced according to the rotation of the rams. Thinning progresses in the angular direction on the surface of the starting rim part, as exhibited in FIG. 5. Finally, the starting rim part (12) is finished into the final rim (2).

What matters is that only a restricted portion of the starting rim part (12) is locally supported at the localized pressing portion by the upper ram (30*b*), the shaping roller (4*a*) or (4*b*) and the lower ram (30*a*) All portions other than the pressing portion are not sustained by the rams and rollers, as demonstrated in FIG. 4. Almost all of the starting disc part (11) is not supported by the upper ram (30*b*) and the lower ram (30*a*). Only the localized pressing portion is so supported. The restricted support of the metal material (10) causes an instability in the state of the material (10). Fluctuation of the pressure of the rollers upon the rams, or fluctuation of the torque of the rams, has a great influence upon the sectional shape of the starting rim part which has just passed the localized pressing portion. The fluctuation of the sectional shape induces an instability in the accuracy of the size of the rim part.

A purpose of the invention is to heighten the accuracy with which the rim part of a product is finished in a rotary forging apparatus. Here the rotary forging apparatus comprises a ram device including a pair of rotating rams facing each other but having axes inclining to each other, a shaping roller device (4) provided at a side of the ram device (3) in order to transform a metal material with a starting disc part and a starting rim part, into a final product having a disc part and a rim part.

SUMMARY OF THE INVENTION

To make a product, e.g. a wheel of an automobile, having a disc part with a first disc surface (1*a*) and a second disc surface (1*b*) and a rim part with a first inner surface, a second inner surface and an outer surface, this invention proposes a rotary Forging apparatus which is characterized by a novel ram device (3). The ram device (3) comprises a first rotary ram (3*a*) with a vertical axis having a first disc pressing surface (31) coinciding with the first surface (1*a*) of the disc part (1) of the product and a first rim shaping surface (32), a second conical, rotary ram (3*b*) with an axis common with the first ram and having an outer surface coinciding with the inner surface of the rim part (2), and a third eccentrically-rotating ram (3*c*) provided in the second ram (3*b*) and having a second pressing surface (33) for forming the second surface of the disc part (1).

The forging apparatus of this invention makes a product from a workpiece by the steps of sandwiching the workpiece (10) with a thick starting disc part and a small starting rim part between the first ram (3*a*) and the second ram (3*b*) together with the third ram (3*c*), rotating the three rams (3*a*), (3*b*) and (3*c*) at a common angular velocity, pressing the workpiece (10) in the axial direction by the rams (3*a*), (3*b*) and (3*c*), thinning the starting disc part with the first ram (3*a*) and the third ram (3*c*), extruding a part of the material out from between the second ram (3*b*) and the first ram (3*a*), finishing the starting rim part (11) into a final disc part (1) with the first disc surface (1*a*) and the second disc surface (1*b*), pressing the extruded part of the material in the radial direction with a rotating shaping roller device (4), expanding the material both upward and downward, thinning the expanding material between the shaping roller (4) and the second ram (3*b*) and between the shaping roller (4) and the first ram (3*a*) and finishing the expanding portion into a final rim part (2).

Two ways are now available for shaping the rim part (2). One is to shape the whole rim part (2) by a single shaping roller. The other is to shape the drop center part and its vicinity using a shaping roller at a first step, and to finish the other rim portions by a conventional spinning process at a second step. The starting material (10) is either a thinner circular plate with an extension beyond the peripheries of the rams or a thicker circular plate without an extension. In the latter case, a peripheral part of the plate gradually expands outside of the rams as a result of the pressure of the rams.

In the apparatus, while the rim part is being shaped by the rams and the shaping rollers, the starting disc part or the shaped disc part is integrally maintained on all the surfaces by the first ram (3*a*) and the second ram (3*b*). The overall support stabilizes the state of the disc material (10). Furthermore, the material of the starting rim part is thinned and expanded by the shaping roller device (4), while supported on all of the inner surface by the second ram (3*b*). Even if the pressure applied to the expanded portion from the shaping roller device (4) and the second ram (3*b*), or the torque, fluctuates during processing of the rim portion, the sectional shape of the rim part of the final product is scarcely affected by the fluctuation.

This invention brings about the following advantages. The final sectional shape of the rim portion is hardly influenced by the fluctuation of the processing conditions of the rams (3*b*) and (3*a*) and the shaping roller device (4). The stability of the sectional shape enhances the precision of the size of the rim part of the product to a great extent.

The effect of raising the accuracy of the rim shape is, of course, still more conspicuous for such a product having a bigger extension part or such a product having a more complicated extension part.

This invention provides a further improvement which aims to facilitate the processing of the rim part (2) by the shaping roller device (4). The improvement is characterized in that the shaping roller device (4) has a rotary roller having generating lines wholly or partially coinciding with the generating lines of the rim part (2) of a product and has a transferring device enabling the rotary roller to be displaced from an initial position spaced by a certain distance from the rams (3*a*) and (3*b*) to a final position at which a small clearance between the generating lines of the rotary roller (4) and the generating lines of the rams (3*b*) and (3*a*) coincides with the whole or a part of the section of the rim part of the product.

The definition of a generating line is now clarified. A generating line can be defined for a member which rotates around a principal axis with respect to which the member is rotationally symmetric. A generating line is defined to be a line which appears as one part of the periphery of the section taken in a plane including the principal axis. Thus, it can be safely said that the member is enclosed and defined by an infinite number of generating lines. Although the infinite number of generating lines are includes in the surface of the object, all the generating lines are entirely identical due to the rotational symmetry of the member.

The rotary roller of the shaping roller device (4) is initially separated far from the first ram (3*a*) and the second ram (3*b*). The transferring device displaces the rotary roller inward until it reaches the periphery of a workpiece and pushes the rotary roller on the outer surface of the workpiece. The rotary roller progresses toward the rams until the clearance between the rotary roller (4*a*) or (4*b*) and the rams (3) comes to coincide with the section of the rim part (2) of the product. Thus, the periphery of the workpiece is being finished into the whole or part of the rim part (2) of the product. This version of the invention improves the facility of the shaping roller device for finishing the rim part.

A further version of the invention aims to simplify the structure of the supporting holding device of the rotary roller. The version is characterized in that the shaping roller device has a rotary roller shaped so as to have generating lines coinciding with the generating lines of the outer surface of the rim part of the product, and the supporting device fixes the axis of the rotary roller at a place at which the clearance between the generating lines of the roller and generating lines of the rams fully or partially coincides with the section of the rim part of product to be made in this version, the axis of the roller is at rest. The pressing clearance does not change at all throughout the process. The transferring device is therefore unnecessary in this case. The structure of the supporting device is simpler than the transferring device, since no continually moving apparatus is required. The outer parts of the material of the workpiece is squeezed out from between the rams (3*a*) and (3*b*). The expelled material is shaped into the rim part by pressing with the rotary roller.

DETAILED DESCRIPTION OF THE PREFERRED EMBODIMENTS

Figure 1:
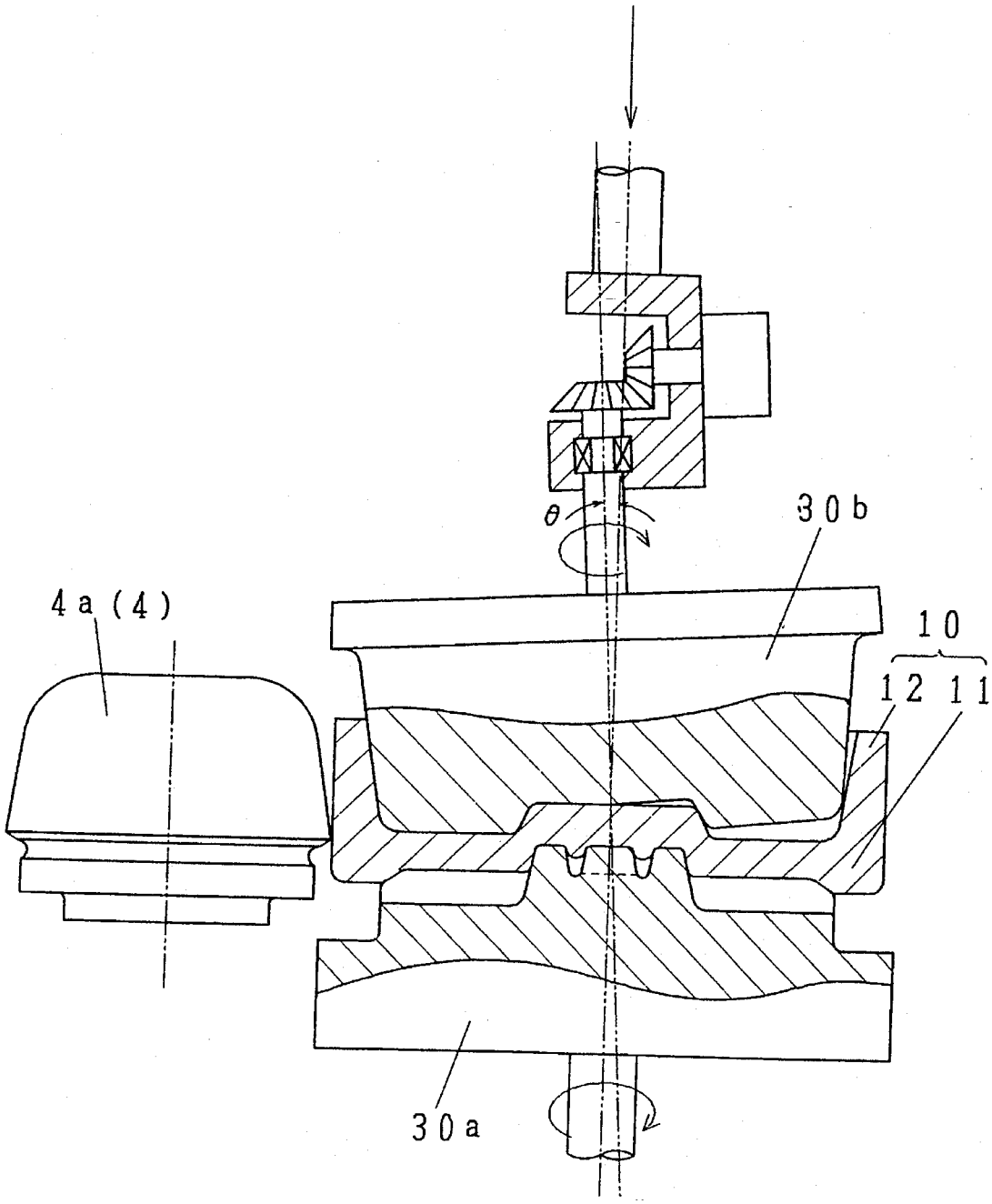
FIG. 1 (PRIOR ART)
FIG. 1 is an explanatory figure of a prior rotary forging apparatus for automobile wheels, having a lower first ram, an upper second ram and a shaping roller, at an initial step.
Figure 2:
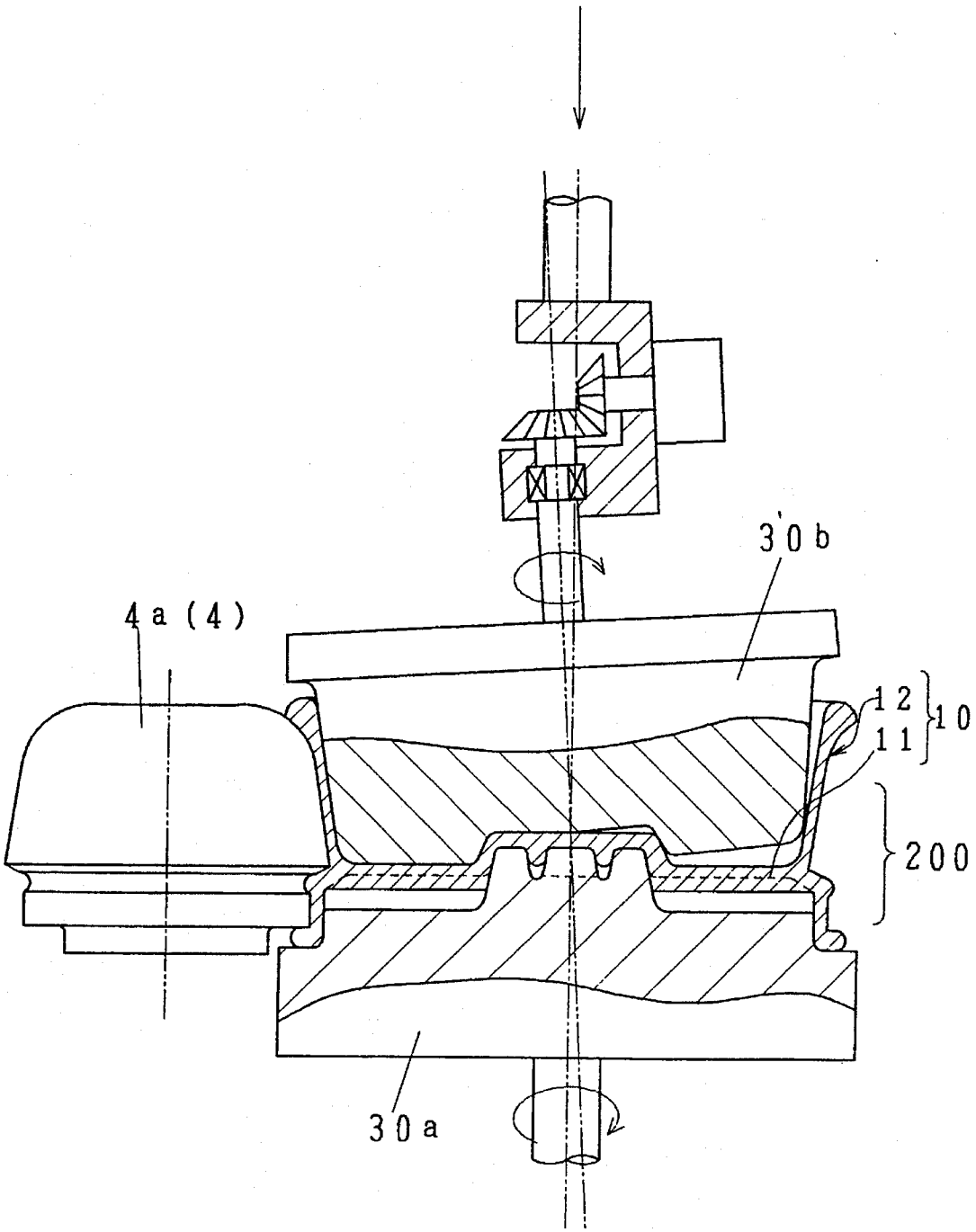
FIG. 2 (PRIOR ART)
FIG. 2 is an explanatory figure of the same rotary forging apparatus at an intermediate step.
Figure 3:
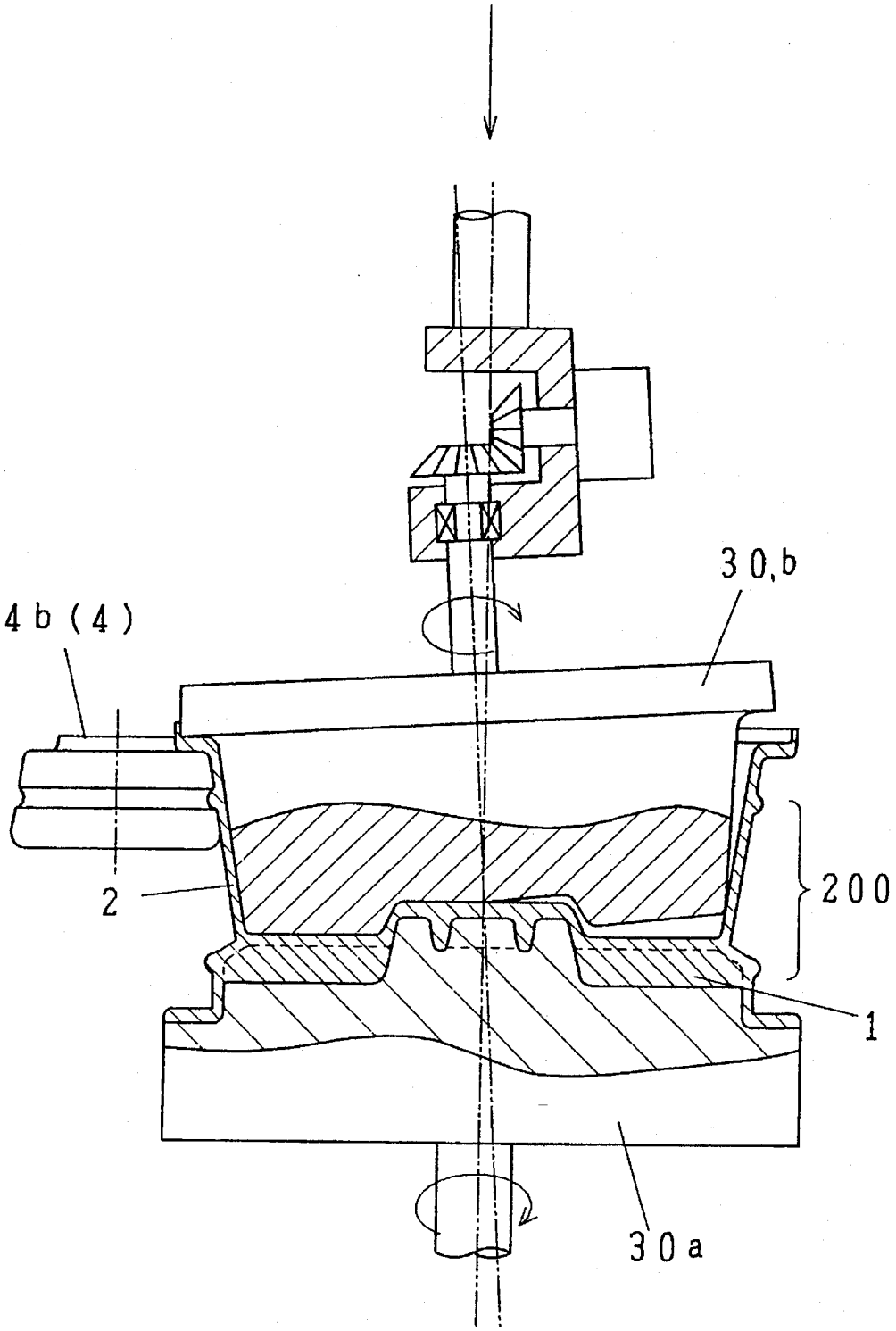
FIG. 3 (PRIOR ART)
FIG. 3 is an explanatory figure of the same rotary forging apparatus at a final step.
Figure 4:
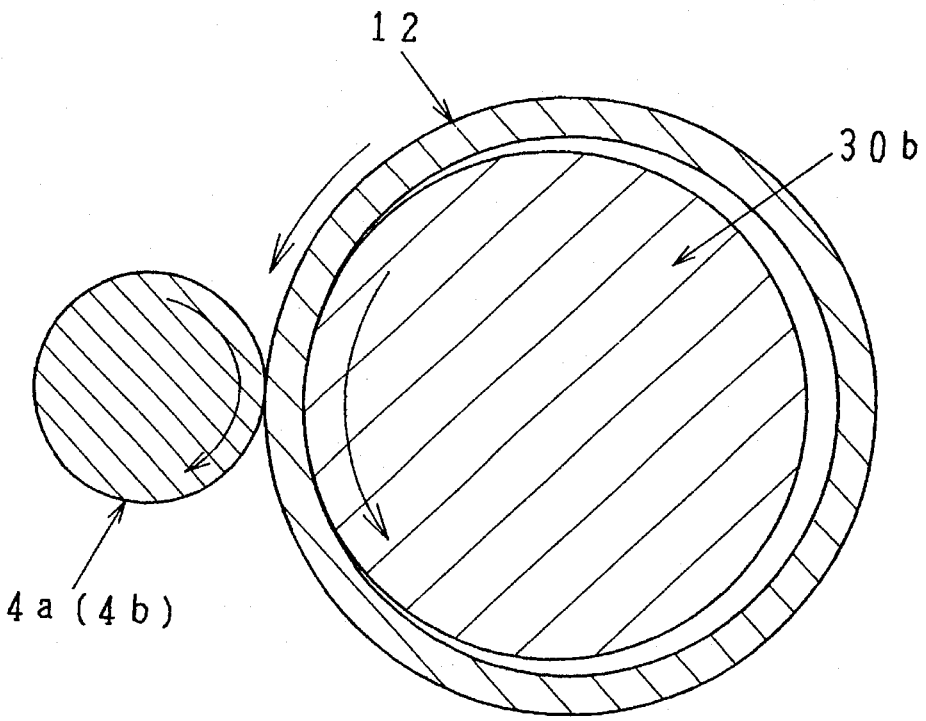
FIG. 4 (PRIOR ART)
FIG. 4 is a horizontal section of a shaping roller, a starting rim part and a second ram while the roller is pressing and thinning the starting rim part on the ram.
Figure 5:
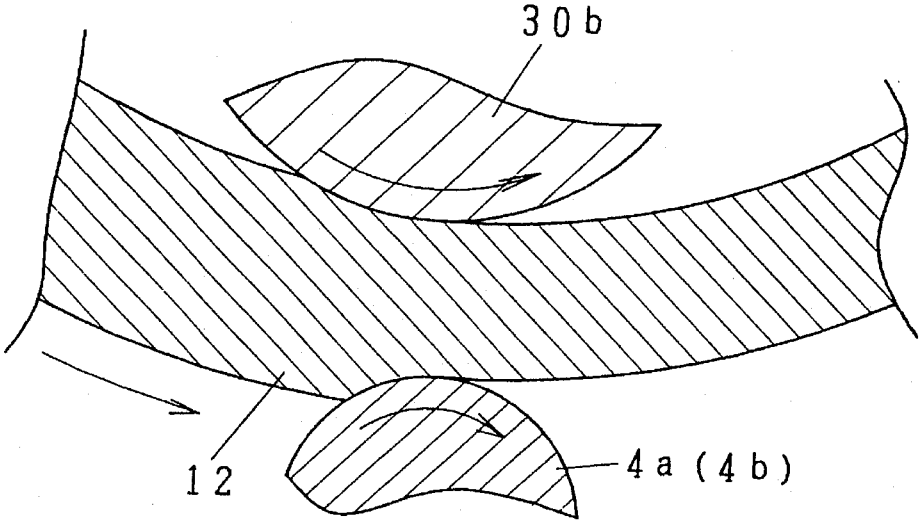
FIG. 5 (PRIOR ART)
FIG. 5 is an enlarged view of the starting rim part while being thinned between the roller and the ram.

Embodiments are explained hereunder by referring to the annexed figures.

[EMBODIMENT 1]

Embodiment 1 applies the rotary forging apparatus of this invention to the production of aluminum wheels of automobiles. FIG. 6 to FIG. 10 illustrate embodiment 1. The rotary forging apparatus employs a ram assembly (3) including a cylindrical second ram (3*b*), a third ram (3*c*) supported in the second ram (3*b*) and a first ram (3*a*) facing upward toward the rams (3*b*) and (3*c*). The first ram (3*a*) is rotated about a vertical axis at a determined position. The third ram (3*c*) and the second ram (3*b*) are supported above the first ram (3*a*). The rams (3*c*) and (3*b*) can be displaced up and down and rotate around independent axes.

A shaping roller device (4) is disposed side by side with the ram assembly. The shaping toiler device can be displaced, while keeping a vertical posture. A transferring device displaces the shaping roller device from an initial spot to a final spot in order to press a starting rim part of a workpiece into a rim part. Embodiment 1 assigns a first disc surface (1*a*) to the decorative outer surface of a wheel. The second disc surface (1*b*) is allocated to the inner surface of the wheel.

[Parts of Embodiment 1]

The first ram (3*a*) has a top pressing surface (31) provided with the same shape as the first disc surface (1*a*) of the wheel. The ram (3*a*) further has a first rim forming surface (32) of a section coinciding with the outer part (2*a*) of the rim part (2). The first ram (3*a*) is supported by a rotary shall connecting to a driving device (not shown in figures) below. The ram (3*a*) is rotated around a vertical axis by the driving device.

The second ram (3*b*) is a cylindrical ram rotatably supported by an annular holder (6). The axis of rotation of the second ram (3*b*) is identical to the rotary axis of the first ram (3*a*). The outer surface of the second ram (3*b*) is a second rim forming surface (34) having a sectional shape complementary to the inner surface of the inner part (2*b*) of the rim part (2).

The structure of the rotatable supporter part of the second ram (3*b*) is now explained. The second ram (3*b*) has a top ring (36) at its upper portion. The annular holder (6) has an upper portion an inner cylinder (63) on the side and an additional flange (62) at the lowest end of the inner cylinder (63). The inner portion of the top ring (36) of the ram (3*b*) is inserted in a space bounded on three sides by the annular holder (6), including the inner cylinder (62) to the inside and the flange (62) below. An axial bearing is sustained between the upper portion of the annular holder (6) and the top ring (36). Another axial bearing is retained between the lower surface of the ring (36) and the flange (62). A radial bearing is sandwiched by the ring (36) and the inner cylinder (63). Thus, the ram (3*b*) can transmit the axial force applied on the annular holder (6) to the workpiece (10).

A plurality of oil pressure jacks (not shown in figures) are installed above the rams. Output shafts (611), (612) and (613) project vertically downward from the bottoms of the jacks. The annular holder (6) is connected to the lower ends of the output shafts (611), (612) and (613). The second ram (3*b*) can rise or fall along the axial line by the movements of the shafts. However, the driving force is not positively applied to the second ram (3*b*), although the ram (3*b*) is rotatable about its vertical axis.

The third ram (3*c*), which is shaped like a cone (having a generally frustoconical shape), is installed in the cylindrical second ram (3*b*). The conical third ram has a shaft which is rotatably supported by a retainer (5) fixed by some means above the third ram (3*c*). However, the shaft is not plumb, but rather slants to the plumb line (axis of ram (3*b*) by an angle θ. The slanting shaft inclines the third ram (3*c*) to the plumb line by the angle θ. Third ram (3*c*) has a second disc pressing surface (33) which occupies the radially outer half of the bottom, and a cavity which is radially inward of the disc pressing surface (33). As a whole, the ram (3*c*) is shaped like a flat conical (frustoconical) drum. The second disc pressing surface (33), which is also conical, inclines by the angle θ to an imaginary bottom surface (plane) perpendicular to the rotary shaft of the third ram (3*c*). Thus, extensions of the generating lines on the second disc pressing surface (33) an meet at a point (300) which coincides with the center of the rotation of the rams (3*a*) and (3*b*). The radius of the second disc pressing surface (33) is equal to the inner radius of the bottom of the second ram (3*b*). Thus, the outer periphery of the third ram (3*c*) is in contact with the inner surface of the second ram (3*b*) at a narrow region. Since the generating lines of the bottom surface of the third ram (3*c*) incline at the angle θ to the bottom plane perpendicular to the axial line, a generating line of the pressing surface is perpendicular to the axial line along the contact line. The disc pressing surface can be in linear contact with the workpiece in the radial direction.

The third ram (3*c*) is rotated by a driving device (51) mounted on the retainer (5). The third ram (3*c*) synchronously rotates in the same direction and at the same effective angular velocity as the first ram (3*a*). The retainer (5) is also supported by an output shaft (52) of an oil pressure jack (not shown) provided above the rams. Thus the third ram (3*c*) can be displaced up and down along the plumb line by the action of the oil pressure jack.

Embodiment 1 employs a first shaping roller (4*a*) and a second shaping roller (4*b*) which have complementary roles. The first roller (4*a*) shapes a region including a drop center (200) and the outer rim part (2*a*). The second roller (4*b*) processes another region beyond the drop center (200) to the end of the inner rim part (2*b*). The shaping roller device (4) consists of the first roller (4*a*) and the second roller (4*b*). The first roller (4*a*) has a section complementarily coinciding with the outer shape of the region between the drop center (200) and the end of the outer rim (2*a*). The second roller (4*b*) has another section complementarily equal to the outer shapes of the other rim part (2*b*, e.g. a hem (22) at an end and a tire bead groove (23) of the inner rim part. [steps of forging]

The aforementioned apparatus produces a wheel by the following steps. A workpiece, i.e. starting material, has a starting disc part (11), and a cylindrical starting rim part (12) expanding around the starting disc part (11). The initial thickness of the starting disc part (11) is set to be slightly larger than the final thickness. The initial thickness of the starting rim part is determined to be bigger than the final thickness of the rim part. However, the initial width of the starting rim part is designed to be shorter than the final width of the rim part. The initial volume of the starting rim part is a little bigger than the volume of the final rim part.

Figure 6:
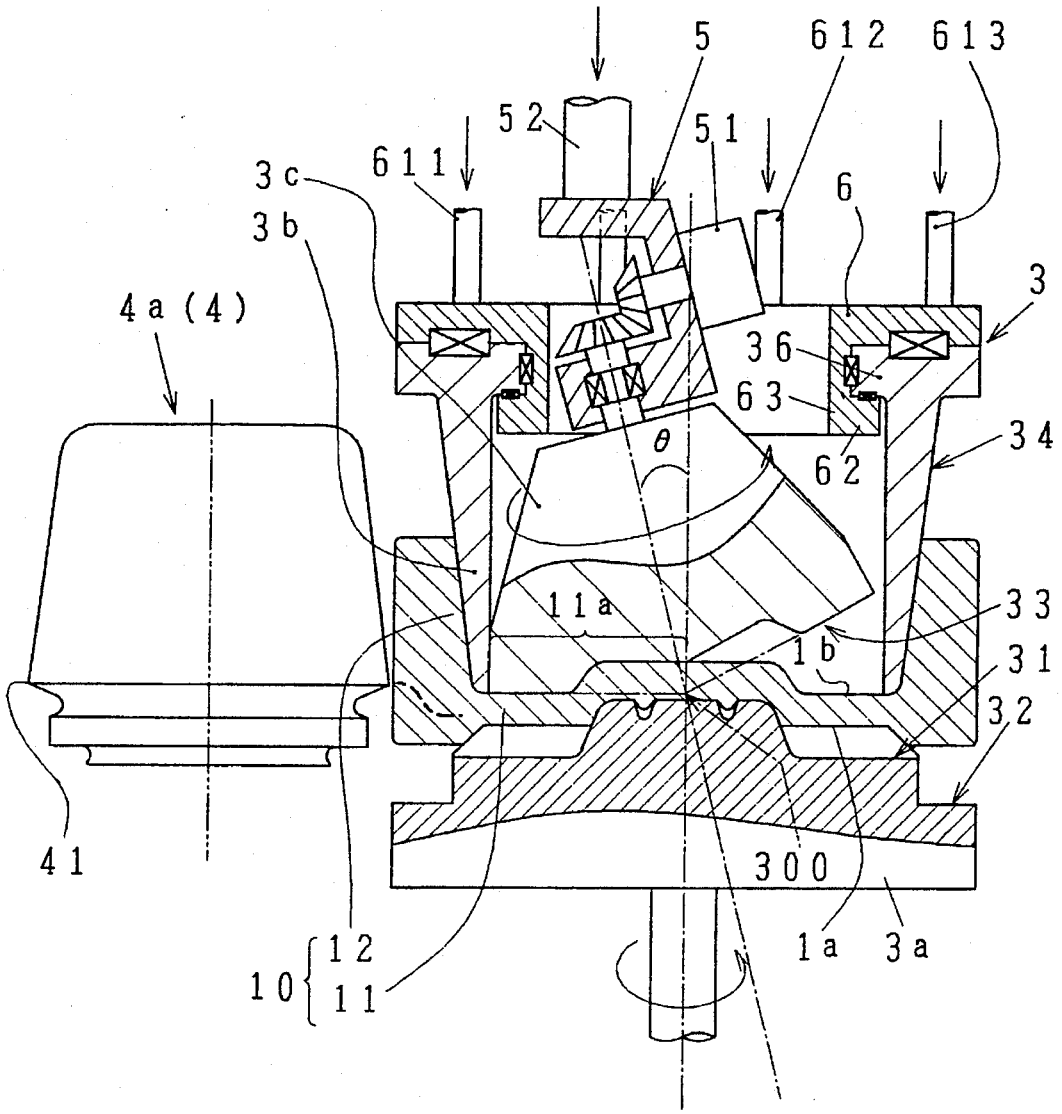
FIG. 6 is an explanatory figure of a first embodiment of a forging apparatus according to the invention, having a lower first ram, an upper second ram and a shaping roller, at an initial step.

The workpiece is set in the rotary forging apparatus by laying the workpiece on the first ram (3*a*), lowering the second ram (3*b*) and third ram (3*c*) to the first ram (3*a*) along the axial line, sandwiching the starting disc part (11) between the first disc pressing surface (31) of the first ram (3*a*) and the second disc pressing surface (33) of the third ram (3*c*), inserting the second ram (3*b*) into the starting rim part (12), inscribing the ram (3*b*) on the starting rim part, and pushing the first shaping roller (4*a*) on the outer surface of the starting rim part (12). In the initial setting, the edge (41) of the roller (4*a*) is in contact with a point which later becomes the drop center, as shown in FIG. 6. Then the rams come into operation. The first ram (3*a*) and the third ram (3*c*) are rotated around their own axes with respective predetermined angular velocities $w_a$ and $w_o$, where $w_a=w_o\cos\theta$). The second and third rams (3*b*) and (3*c*) further press down on the workpiece (10). Simultaneously the first roller (4*a*) begins pressing the workpiece inward in the horizontal direction. The first roller (4*a*) progresses along the dotted curve drawn in the section of the workpiece in FIG. 6.

Sandwiching the starting disc part (11), the first ram (3*a*) and the third ram (3*c*) are synchronously rotated positively by their own driving devices. The second ram (3*b*) does not have its own driving device in this example, however, the second ram (3*b*) also is rotated with the same angular velocity $w_a$ around the vertical axis as the other two rams, since the second ram (3*b*) strongly presses against the starting disc part (11). The three rams rotate in the same direction at the same velocity $w_a$ around the vertical axis.

Otherwise, the second ram (3*b*) may be also driven in another version of embodiment 1. In this version, three driving means will positively rotate the three rams independently but synchronously. In still another version only the first ram (3*a*) is driven, while the second and the third rams (3*b*) and (3*c*) are free to accompany the rotation of the first ram (3*a*).

The pressure of the third ram (3*c*) and the first ram (3*a*) deforms the disc starting part (11) after the shape of a cavity formed between the first pressing surface (31) and the second pressing surface (33). The bottom of the disc part becomes the first disc surface (1*a*) which is a negative of the first pressing surface (31) of the first ram (3*a*). The top of the disc part becomes the second disc surface (1*b*) which is a negative of the second pressing surface (33) of the third ram (3*c*). Then the disc part (1) is completely formed.

The pressing by the first roller (4*a*) forces the second ram (3*b*) to bend inward slightly. Thus, the second ram (3*b*) favorably comes into tighter contact with the third ram (3*c*).

The rotary forging apparatus controls the second ram (3*b*) in order to synchronize the descent of the second ram (3*b*) with the lowering of the third ram (3*c*) that thins the starting disc part of the workpiece. The bottom end of the second ram (3*b*) is forced into the inner corner of the starting disc part (11). The lower portion (34) of the second ram (3*b*) tapers like a cone with a smallest diameter at the lower end. The taper guides the lowering progress of the ram (3*b*) into the starting rim part. A comparatively small force still enables the second ram (3*b*) to push the workpiece down.

The rotary forging machine further preferably maintains the bottom surface of the third ram (3*c*) pressing the starting disc part (11*a*) to be slightly lower than the lowest point of the second ram (3*b*). The second ram (3*b*) therefore, accompanies the descent of the third ram (3*c*), with a short delay. What transforms the starting disc part is solely the third ram (3*c*) with its wide blunt pressing surface (33). Thus, the second ram (3*b*) is immune to deformation due to a counter force from the workpiece in the example. Otherwise, this rotary forging apparatus still allows the bottom end of the second ram (3*b*) to be level with the bottom surface of the third ram (3*c*).

Figure 7:
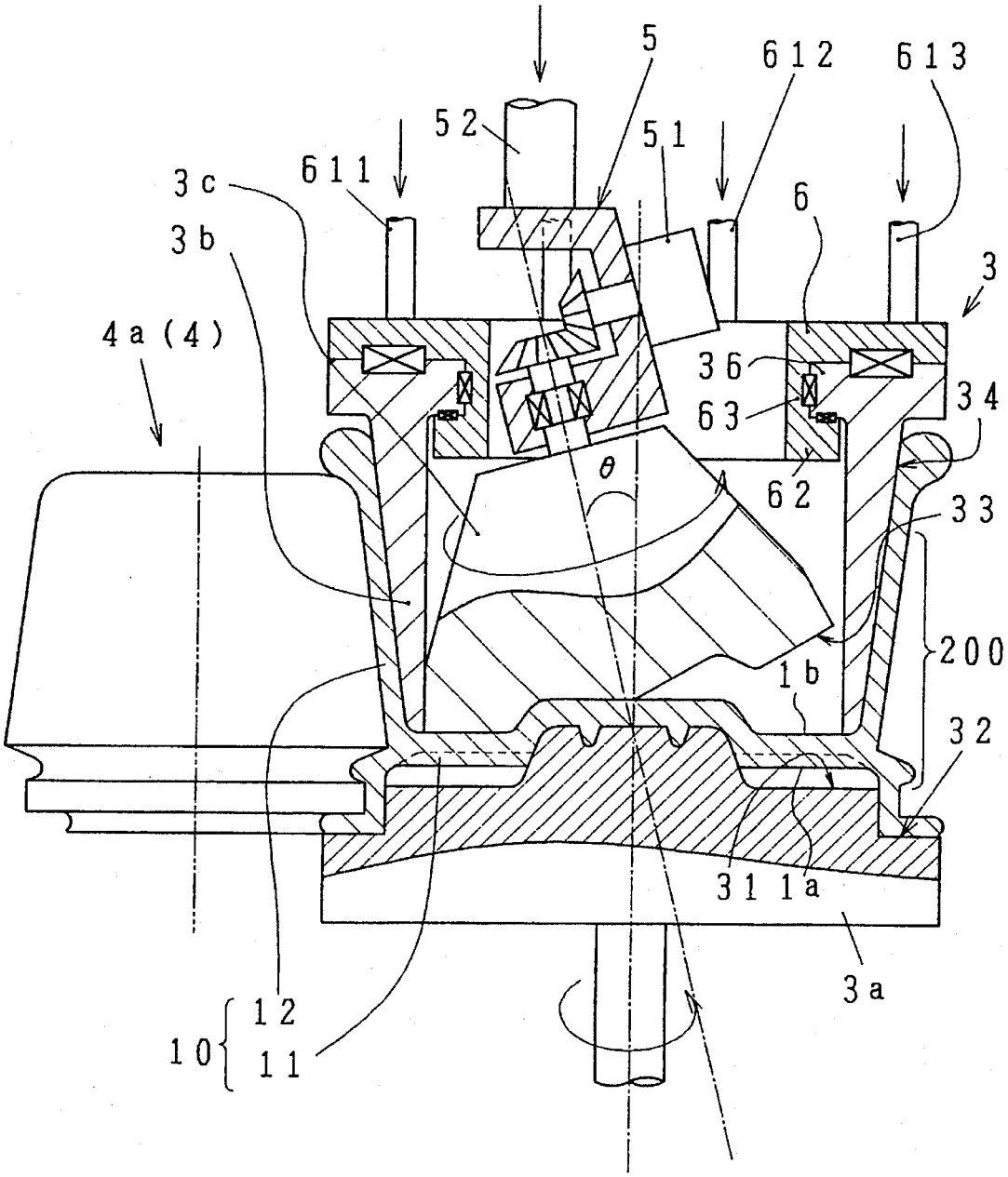
FIG. 7 is an explanation figure of the same embodiment at an intermediate step.
Figure 8:
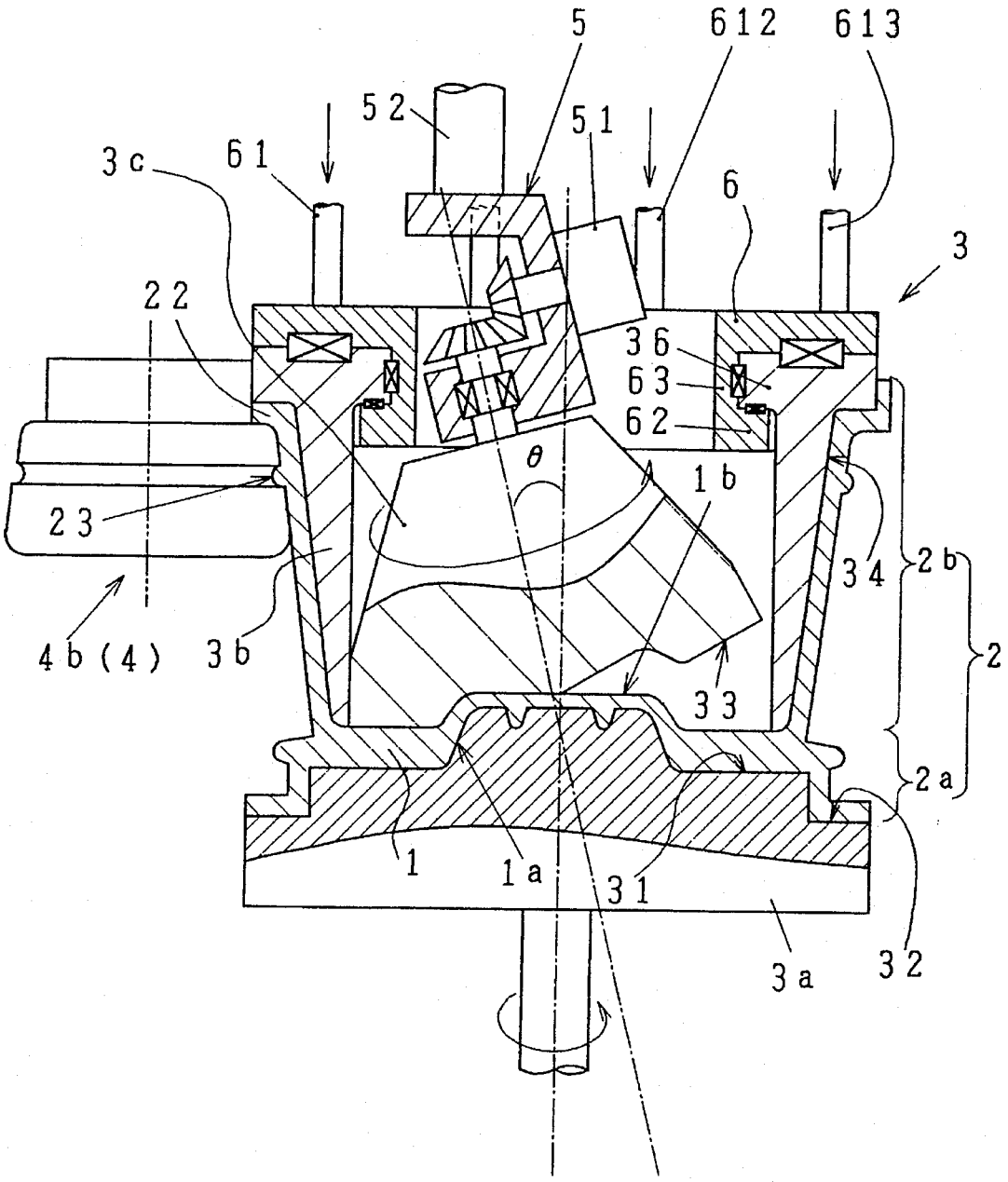
FIG. 8 is an explanatory figure of the same at the final step.
Figure 9:
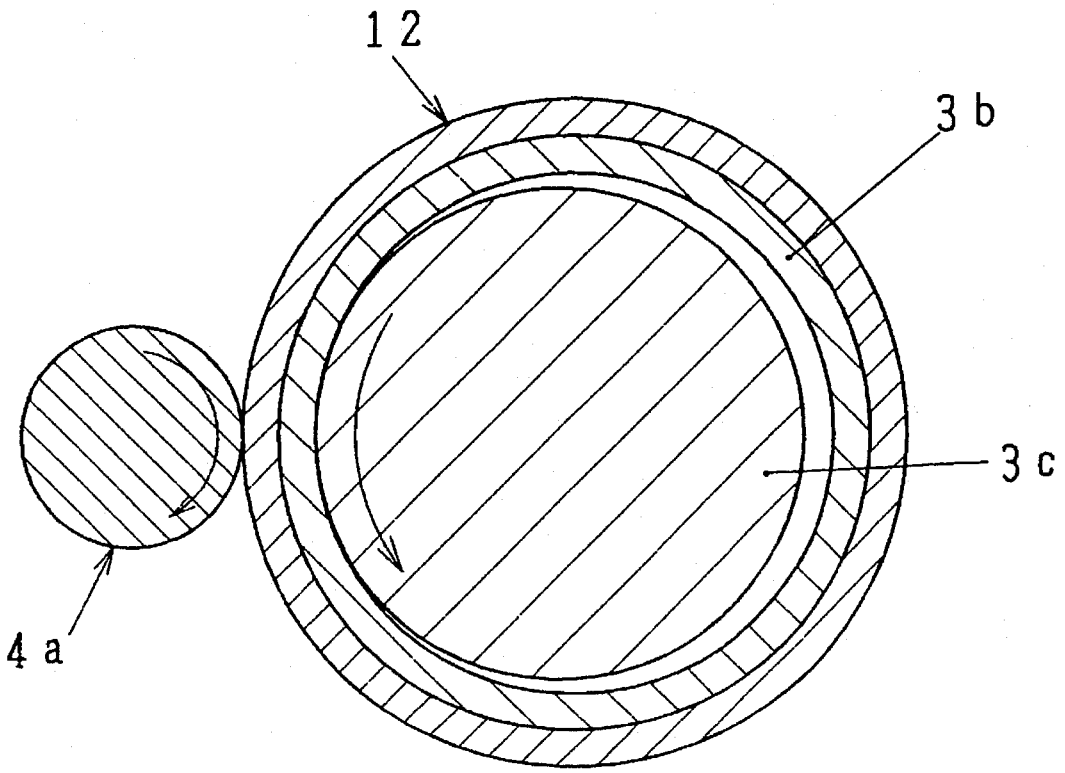
FIG. 9 is a horizontal sectional view of the shaping roller, the starting rim part and the second ram of the first embodiment at a step of pressing and thinning the starting rim part by the roller on the ram.

While the third ram (3*c*) is shaping the starting disc part into a final disc part, the first roller (4*a*) is simultaneously transforming the starting rim part (12) into a final rim part. The roller transferring apparatus (not shown) guides the shaping roller (4*a*) so that the edge of the roller moves along the curved dotted line shown in FIG. 6. The first roller (4*a*), the first ram (3*a*) and the second ram (3*b*) together press the material of the starting rim part (12) and cooperatively form a drop center (200) and an outer rim part (2*a*), as illustrated in FIG. 7 and FIG. 8. Then a second roller (4*b*) replaces the first roller (4*a*). Pressing the end of the inner rim portion against the side of the second ram (3*b*), the second roller (4*b*) finishes the inner rim part (2*b*), as shown in FIG. 8.

This invention enables the whole starting rim part (12) of a workpiece to circumscribe the first ram (3*a*) and the second ram (3*b*) during the shaping of the rim part (2). Namely the whole inner surfaces of the starting rim part (12) is maintained in tight contact with the outer surface of the second ram (3*b*), as clearly shown by FIG. 9. The workpiece (10) is firmly held by the second ram (3*b*). Fluctuation of shaping conditions, e.g. pressures of the rams or rollers, has little influence upon the final section of the rim part (2). The stability of the workpiece in the rams eliminates the fluctuation of the sectional shapes of the rim part.

Embodiment 1 synchronizes the shaping of the starting rim part with the shaping of almost all of the starting disc part as explained above. Otherwise, this invention can be also put into practice by a first version of embodiment 1 shapes the disc part and the rim part at different times instead of performing synchronous finishing. Namely, the disc-formation precedes the rim-shaping in this version. In this case, when the rim part has been shaped, the axial pressure between the first ram (3*a*) and the third ram (3*c*) is reduced so as not to thin the finished disc part any more. The rams (3*a*), (3*b*) and (3*c*) are still rotating at the same angular velocity. Then the first roller (4*a*) and the second roller (4*b*) begins shaping the starting rim part from the side, while rotating with the same tangential speed as the starting rim part.

A conventional spinning processing can further replace the shaping of the inner rim portion by the second roller (4*b*) in a second version of embodiment 1.

Figure 10:
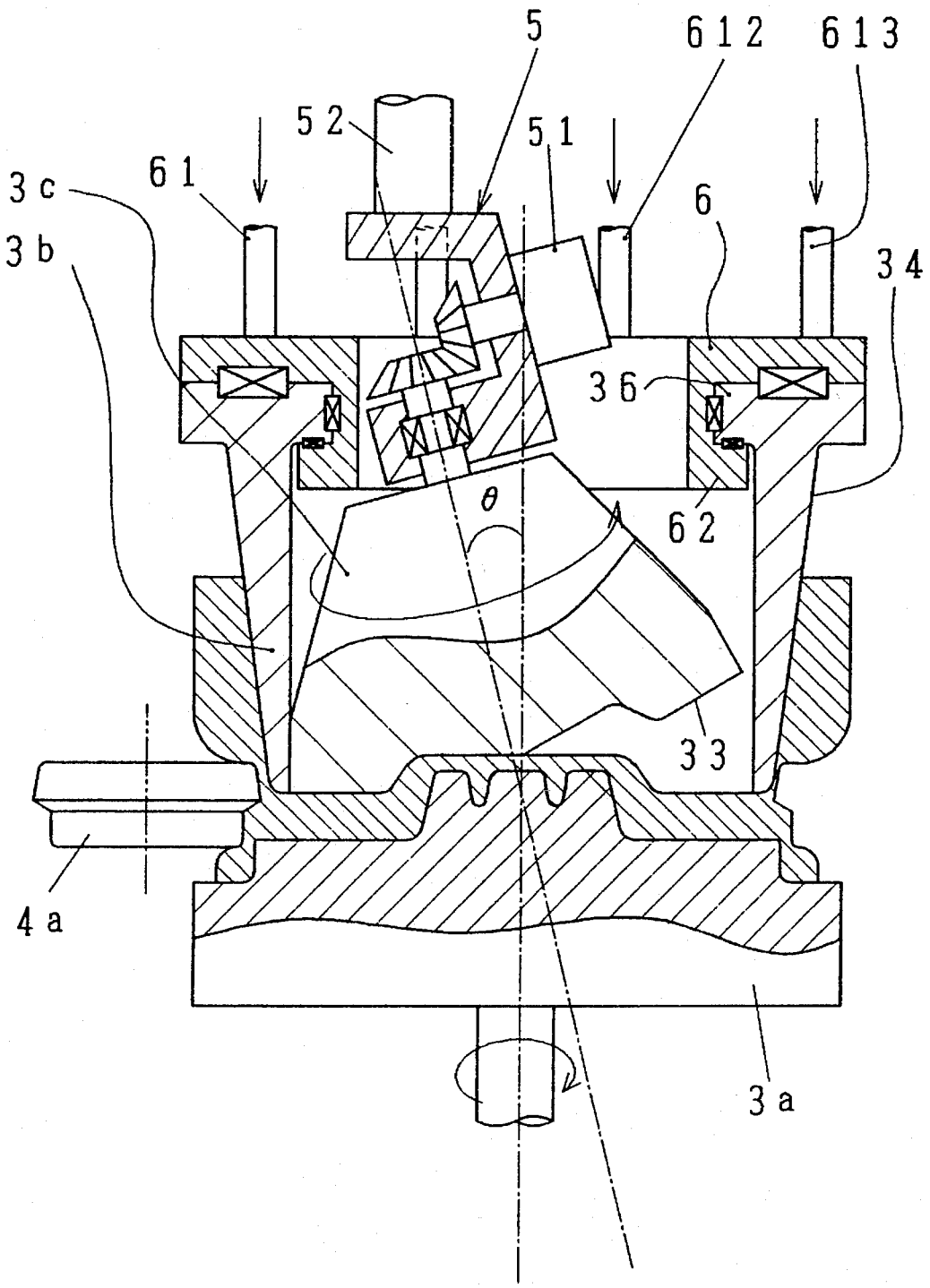
FIG. 10 is a explanatory figure of the first embodiment adopting a variation of the rotary roller.

A third version will replace the formation of the inner rim and the outer rim parts by conventional spin processing. This version adopts a simpler, smaller first roller (4*a*) having a section which is just a negative of the central part of the drop center (200). The roller transferring device (not shown in figures) merely presses the first roller (4*a*) on the side of the workpiece in the horizontal direction, as shown in FIG. 10. The formation of the drop center will be followed by spin processing for shaping the inner portion of the starting rim part and the outer rim part in the third version.

[EMBODIMENT 2]

Figure 11:
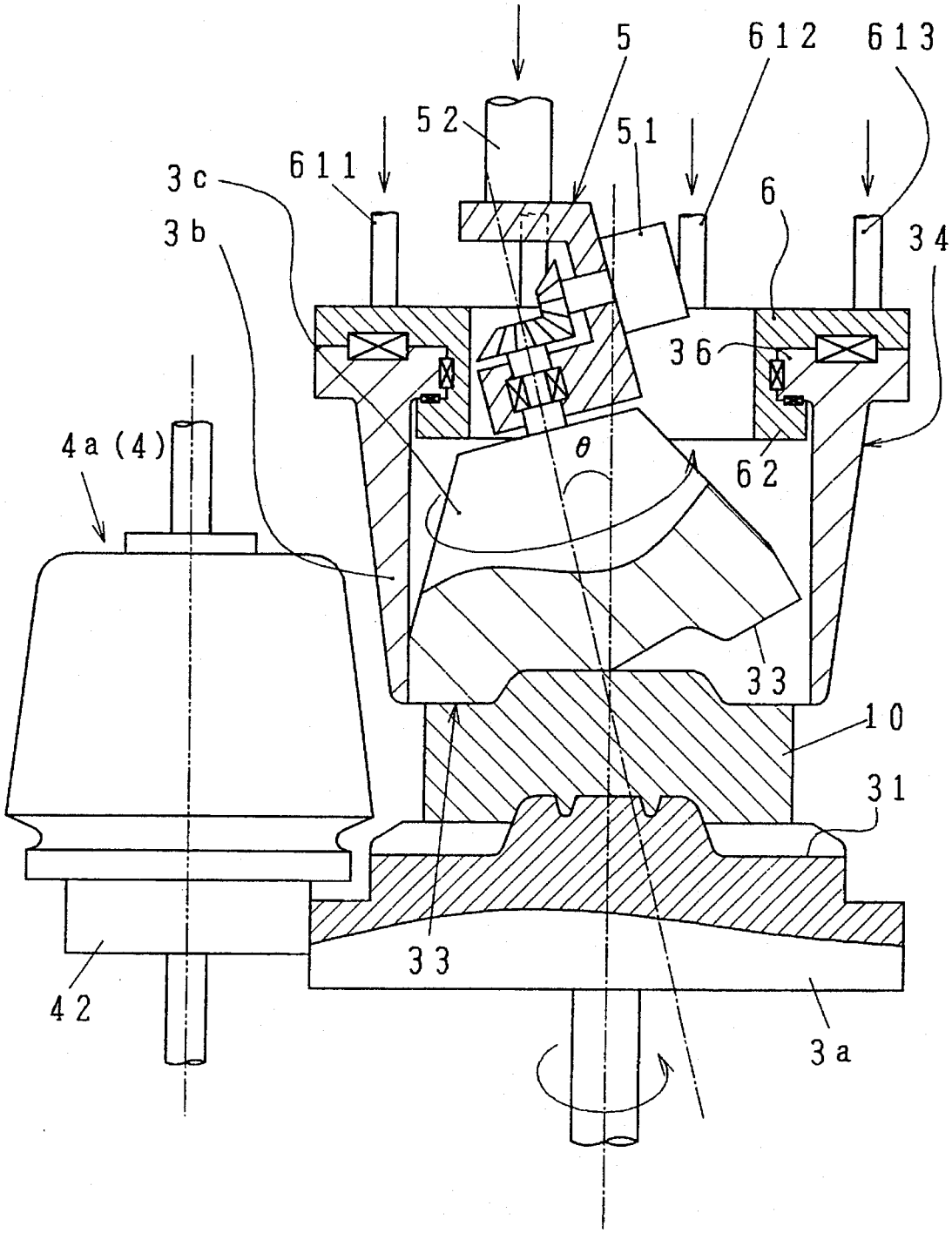
FIG. 11 is an explanatory figure of a second embodiment of this invention at an initial step.
Figure 12:
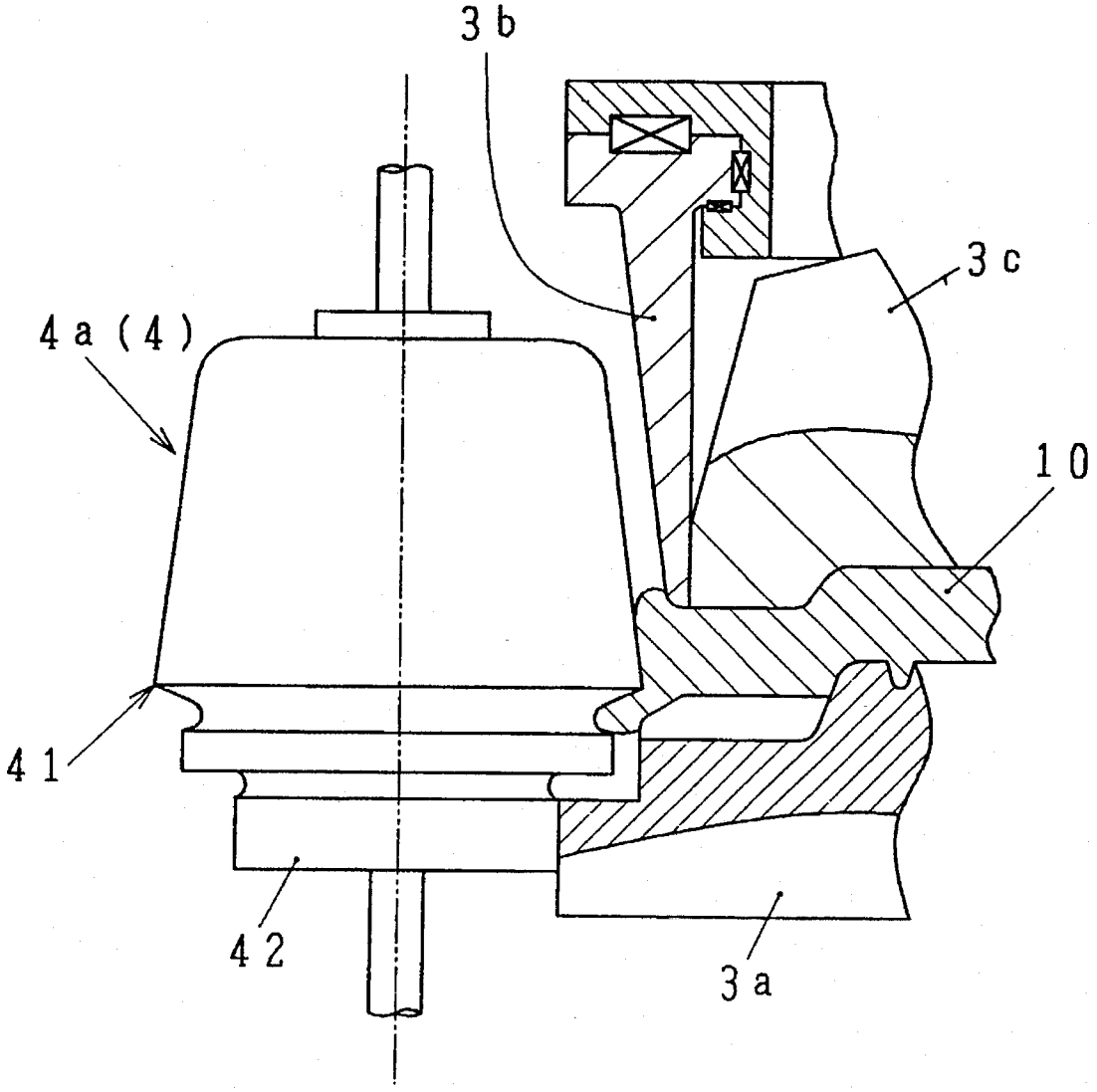
FIG. 12 is an explanatory view of the shaping roller pressing and forming the periphery of the squeezed material, at an intermediate step.
Figure 13:
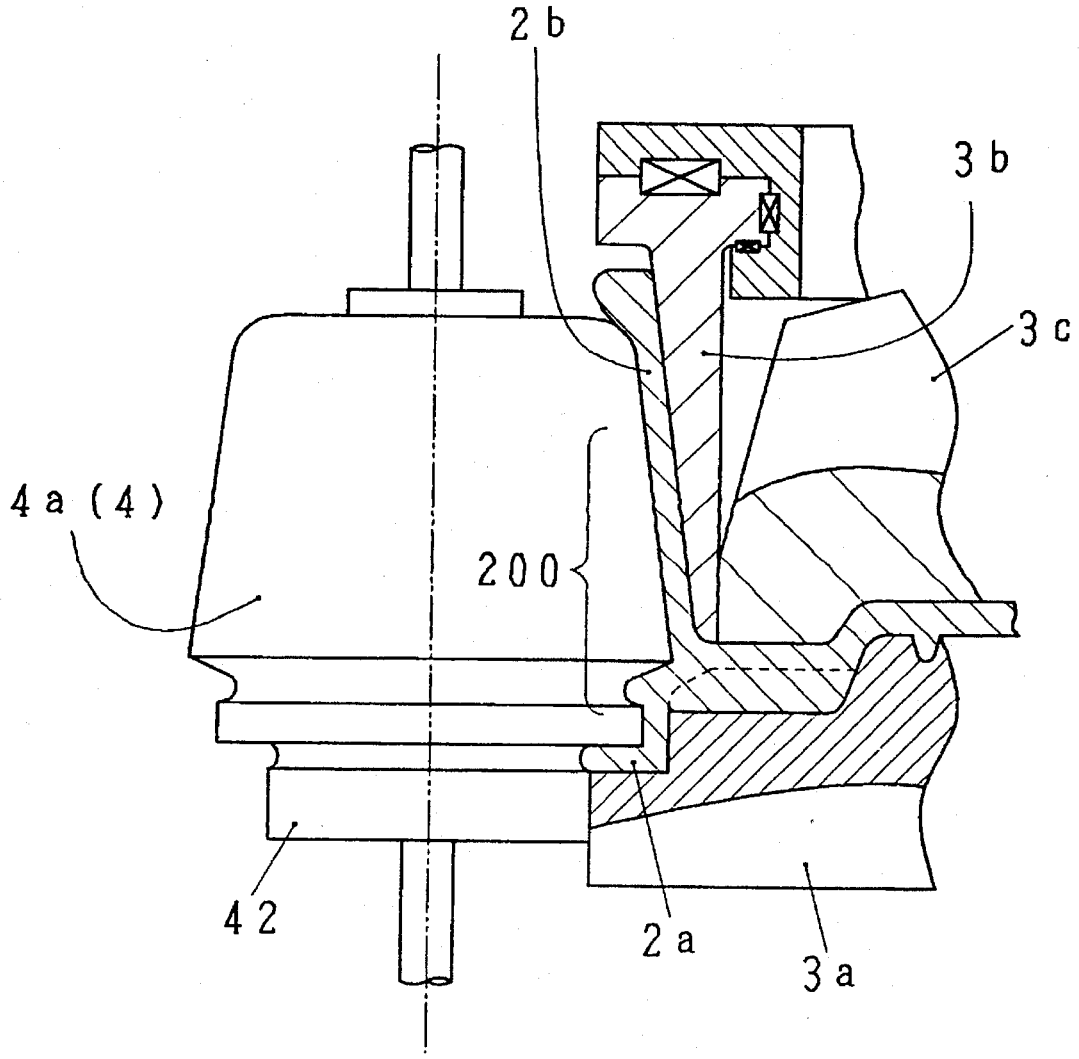
FIG. 13 is an explanatory view of the shaping roller finishing the rim part of the product at final step.

Embodiment 2 employs substantially the same rotary forging apparatus as embodiment 1. FIG. 11 to FIG. 13 demonstrate embodiment 2 which maintains the shaping roller (4*a*) at a constant position instead of moving it in a horizontal direction as with embodiment 1. Embodiment 2 dispenses with the transferring device of the roller. A roller supporter (not shown) sustains the shaping roller (4*a*) at a certain spot beside the first ram (3*a*) and the second ram (3*b*). The axis of the shaping roller does not move. The rotary forging apparatus of embodiment 2 will be clearly understood from the following explanation of a concept of "shaping clearance". The shaping clearance is defined to be a narrow, quasi-closed space lying on the plumb plane including the axes and being sandwiched by the generating lines of the first roller (4*a*), the first ram (3*a*) and the second ram (3*b*). In other words, the shaping clearance is a projection of the generating lines of the rams (3*a*), (3*b*) and roller (4*a*) on the plumb plane including the axes of the rams and the roller. The rotary forging apparatus harmonizes the shaping clearance with the section of the final product at a drop center, an outer rim part and almost all of the inner rim part. The shape of the product is uniquely determined by the shaping clearance. In this example, a smaller bottom drum (42) of the roller (4*a*) is in contact with a bottom extension of the first ram (3*a*). The shaping clearance is thus closed at the lowest end, which enables the apparatus to form the outer rim part without an additional operation. The shaping clearance has an open end only at the top.

Embodiment 2 adopts a simple, initially cylindrical workpiece (10) having a diameter a little smaller than the outer diameters of the second ram (3*b*) and the first ram (3*a*). The volume of the work is a trifle bigger than the volume of the final wheel product.

The apparatus holds the workpiece (10) between the third ram (3*c*) and the first ram (3*a*) and rotates the third ram (3*c*), the second ram (3*b*) and the first ram (3*a*) synchronously for pressing and distorting the workpiece (10) into a disc part defined by the surfaces of the rams (3*c*) and (3*a*).

Thinning the workpiece (10) in the axial direction, the rotary forging gradually extrudes the extra material out from between the peripheries of the rams (3*b*) and (3*a*). Embodiment 2 preferably maintains the bottom level of the third ram (3*c*) a little lower than the bottom of the second ram (3*b*) during the rotary forging, like embodiment 1. Desirably, the difference of the bottom levels should be a bit bigger than the difference of embodiment 1.

Being carved by the edge (41) of the first shaping roller (4*a*), the extruded material is expanding radially and vertically in the shaping clearance, while the the rams and the roller rotate at nearly the same line velocities. As already explained, the position of the first roller (4*a*) is predetermined so as to equalize the section of the shaping clearance between the rams and the rollers to the section of the drop center, the outer rim and almost all of the inner rim part of a product, as illustrated in FIG. 13. The roller (4*a*) cooperates with the rams (3*b*) and (3*a*) to shape the extended material into an intermediate piece with the drop center (200), the outer rim part (2*a*) and almost all of the inner rim part (2*b*). The disc part (1) is also finished almost at the same time that the rim part (2) is finished.

Then a second shaping roller (4*b*) finishes the top end of the inner rim part (2*b*) like embodiment 1 does, e.g. as shown in FIG. 8. Of course, the pressure should be alleviated between the upper ram (3*c*) and the lower ram (3*a*) to thin the disc no more.

Finally, the product is removed from the apparatus by lifting the upper rams (3*b*) and (3*c*) out of contact with the product. Preferably, the roller supporting device (not shown in figures) should carry the rollers (4*a*) and (4*b*) away from the product in a horizontal direction to facilitate the removal of the product from the first ram (3*a*).

[EMBODIMENT 3]

Figure 14:
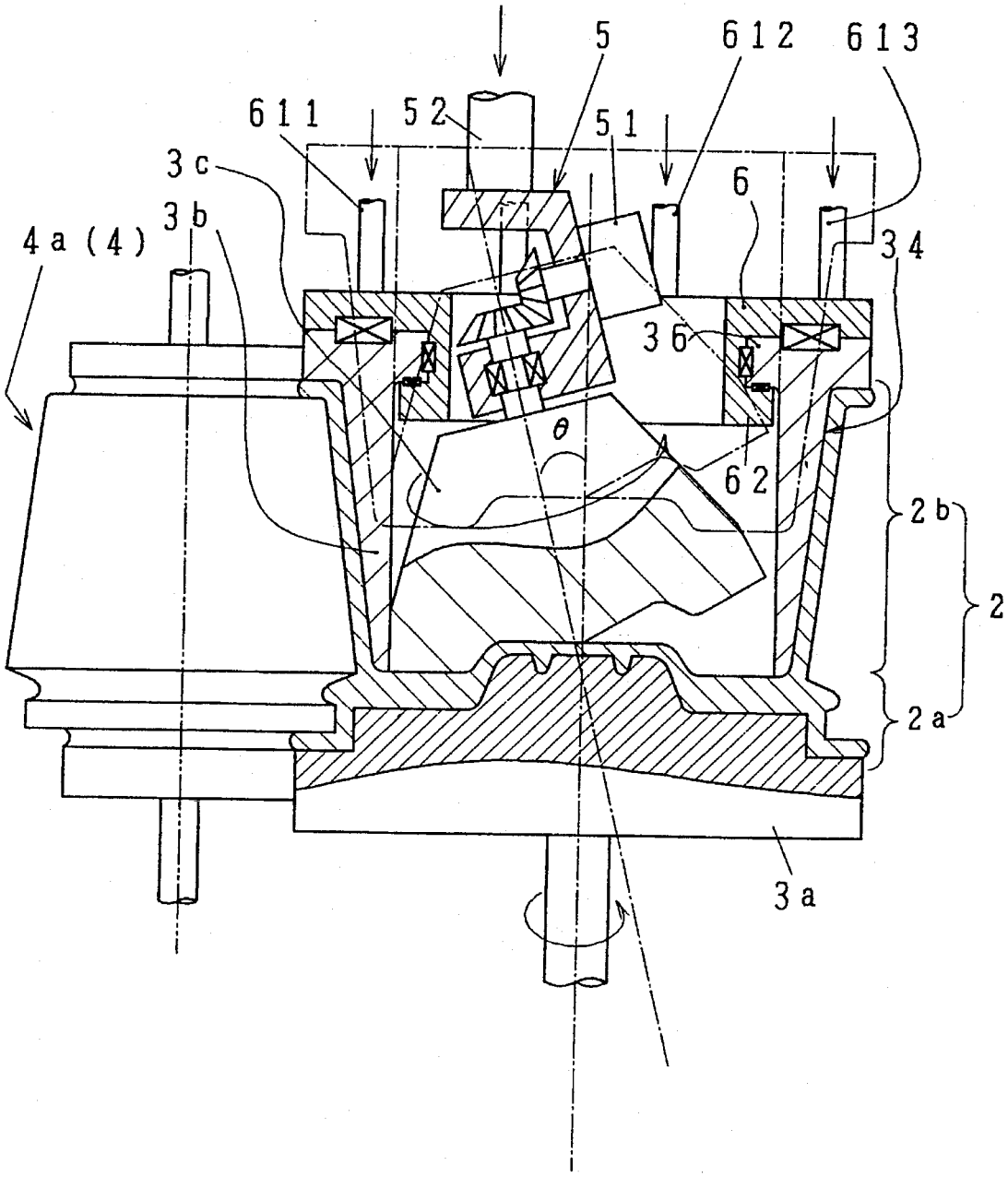
FIG. 14 is an explanatory figure of a third embodiment at final stage.

Embodiment 3 has a single roller (4*a*) alone. The sectional shape of the shaping roller (4*a*) coincides negatively with the whole outer surface of the rim part of a product. FIG. 14 shows the rotary forging apparatus of embodiment 3. A single-dotted line designates the initial height of the upper rams (3*b*) and (3*c*). The first ram (3*a*) and the shaping roller (4*a*) are set at their own positions from the beginning. Rotating around their axes, the upper rams (3*c*) and (3*b*) press a bulky workpiece (10) down against the bottom ram (3*a*). The material of workpiece (10) is thinned according to the descent of the rams (3*c*) and (3*b*). The material flows from the inner space between the third ram (3*c*) and the first ram (3*a*) into the shaping clearance enclosed by the single roller (4*a*), the first ram (3*a*) and the second ram (3*b*). Then the material fills the shaping clearance. The rim part (2) is finished by the single roller (4*a*) in a single process. Solid lines denote the sectional shape of the rim part of the product. Embodiment 3 requires a design of the shaping clearance suitable for the flow of the extruded material. Embodiments 3 succeeds in simplifying the structure of a rotary forging apparatus by finishing the whole rim part of a wheel using a single roller.

The embodiments have all arranged the second ram (3*b*) and the third ram (3*c*) on the side of the inner rim part (2*b*). Nevertheless, the relation can be reversed for all examples. Namely such versions will make the inner rim part by the first ram and the outer rim part by the second ram together with the shaping rollers.

The embodiments aim at the rotary forging of aluminum wheels of automobiles. However, this invention also can be applied to a rotary forging apparatus of other products.

Independent supporting devices sustain and lower the third ram (3*c*) and second ram (3*b*) separately in the preceding embodiments. Another version of this invention can employ a common supporting device for the second ram (3*b*) and the third ram (3*c*).

What I claim is:

1. A rotary forging apparatus for making a product from a workpiece of plastic metal material, the product having a disc part and a rim part, the disc part having a first disc surface and a second disc surface, the rim part having an outer surface, a first inner surface that communicates with the first disc surface and a second inner surface that communicates with the second disc surface, the apparatus comprising:

a first rotary ram rotatable around a common axis and having a first disc pressing surface and a first rim shaping surface, the first disc pressing surface conforming to the first disc surface of the product, the first rim shaping part conforming to the first inner surface of the rim part, a hollow second rotary ram facing the first ram, the second ram being rotatable around the common axis and having a second rim shaping surface conforming to the second inner surface of the rim part, a generally conical third rotary ram having a curved bottom which serves as a second disc pressing surface, the third ram being provided in the second ram and being rotatable around an oblique axis slanting with respect to the common axis, the second disc pressing surface being configured to form the second disc surface, a shaping roller device comprising at least a shaping roller at a side of the rams, the shaping roller having a section configured to form at least a portion of the outer surface of the rim part and being rotatable around a roller axis parallel with the common axis for shaping the rim part, and a roller supporting device for sustaining the shaping roller adjacent the rams, wherein the workpiece is sandwiched between the first ram and the second ram, wherein the third ram presses the workpiece against the first ram and shapes the disc part, and wherein a portion of the workpiece is extruded from the rams and is pressed from the side by the shaping roller device for shaping the rim part.

2. A rotary forging apparatus as claimed in claim 1, wherein the second disc pressing surface of the third ram is a little lower than a bottom end of the second ram when the second disc pressing surface is in contact with the workpiece.

3. A rotary forging apparatus as claimed in claim 1, wherein the disc part of the product is a disc part of a wheel of an automobile, the first rim shaping surface of the first ram conforms to the inner surface of the outer rim part of the wheel and the second rim shaping surface of the second ram conforms to the inner surface of the inner rim part of the wheel.

4. A rotary forging apparatus as claimed in claim 1, wherein the shaping roller has generating lines conforming to at least some parts of generating lines of the rim part and a roller transferring device moves the shaping roller with the roller supporting device between an initial position far from the rams and a final position at which a shaping clearance between the shading roller and the rams is equal to at least some part of the section of the rim part of the product.

5. A rotary forging apparatus as claimed in claim 1, wherein the shaping roller device contains at least a shaping roller having generating lines conforming to at least some parts of generating lines of the rim part and the roller supporting device sustains a certain spot at which a shaping clearance between the shaping roller and the rams is equal to at least some part of the section of the rim part of the product.

6. A rotary forging apparatus as claimed in claim 2, wherein the shaping roller has generating lines coinciding with at least some parts of generating lines of the rim part and a roller transferring device moves the shaping roller with the roller supporting device between an initial position far from the rams and a final position at which a shaping clearance between the shaping roller and the rams is equal to at least some part of the section of the rim part of the product.

7. A rotary forging apparatus as claimed in claim 2, wherein the shaping roller has generating lines coinciding with at least some parts of generating lines of the rim part and the roller supporting device sustains the shaping roller at a certain spot at which a shaping clearance between the shaping roller and the rams is equal to at least some part of the section of the rim part of the product.

8. A rotary forging apparatus as claimed in claim 3, wherein the shaping roller device contains only a single roller having generating lines coinciding with the whole of the generating lines of the outer surface of the rim part of the wheel.

9. A rotary forging apparatus for making a product from a workpiece of plastic metal material, the product having a disc part and a rim part, the disc part having opposite first and second disc surfaces, the rim part having an outer surface, a first inner surface that communicates with the first disc surface and a second inner surface that communicates with the second disc surface, the apparatus comprising:

a first rotary ram, rotatable about a common axis and having a first disc pressing surface and a first rim shaping surface, the first disc pressing surface conforming to the first disc surface of the product, the first rim shaping part conforming to the first inner surface of the rim part, a hollow second rotary ram facing the first ram, the second ram being rotatable about the common axis and having a second rim shaping surface conforming to the second inner surface of the rim part, a third rotary ram having a curved bottom which serves as a second disc pressing surface, the third ram being provided in the hollow second ram so as to oppose the first ram, the third ram being rotatable around an oblique axis slanting with respect to the common axis, the second disc pressing surface being configured to form the second disc surface, a shaping roller adjacent to a side of the rams, the shaping roller having a section configured to form at least a portion of the outer surface of the rim part, the shaping roller being rotatable about a roller axis that is parallel with the common axis, and wherein the workpiece is sandwiched between the first ram and the second and third rams, wherein the third ram presses the workpiece against the first ram and shapes the disc part, and wherein a portion of the workpiece is extruded from between the rams and is pressed from the side by the shaping roller to shape the rim part.

10. A rotary forging apparatus as claimed in claim 9, wherein the shaping roller is mounted for movement along a line that is substantially perpendicular to the common axis.

11. A rotary forging apparatus as claimed in claim 9, wherein the product is a wheel of a vehicle, and the rim supports a tire.

12. A rotary forging apparatus as claimed in claim 10, wherein the outer surface of the rim part of the product has a protruding annular bead, and the shaping roller has an annular groove which forms an annular bead.

* * * * *